US008061539B2

(12) United States Patent
Punzel et al.

(10) Patent No.: US 8,061,539 B2
(45) Date of Patent: Nov. 22, 2011

(54) STORAGE SYSTEM WITH ACCESSORY MOUNTING RAIL

(75) Inventors: William H. Punzel, Edgerton, WI (US); Matthew A. Tourdot, Whitewater, WI (US); Michelle M. Smith, Janesville, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 380 days.

(21) Appl. No.: 12/132,432

(22) Filed: Jun. 3, 2008

(65) Prior Publication Data

US 2008/0296245 A1 Dec. 4, 2008

Related U.S. Application Data

(60) Provisional application No. 60/941,850, filed on Jun. 4, 2007.

(51) Int. Cl.
*A47H 1/00* (2006.01)

(52) U.S. Cl. ..... 211/103; 211/187; 211/190; 211/207; 108/108; 248/220.21

(58) Field of Classification Search ..... 108/106–108, 108/147.11, 147.17; 248/222.13, 220.21, 248/220.41, 220.43, 316.8, 242; 211/102, 211/126.1, 208, 94.01, 103, 187, 190, 207, 211/193, 192, 88.01
See application file for complete search history.

(56) References Cited

U.S. PATENT DOCUMENTS 3,067,882 A * 12/1962 Ribbens et al. ..... 108/102
3,182,945 A * 5/1965 Sedo ..... 248/242
3,248,079 A * 4/1966 Kennedy ..... 248/242
4,008,873 A * 2/1977 Travaglio et al. ..... 248/242
4,228,906 A * 10/1980 Jones ..... 211/88.01
4,307,671 A * 12/1981 Albano ..... 108/6
4,349,113 A * 9/1982 Schreiner ..... 211/103
4,377,241 A 3/1983 Schreiner
4,378,925 A * 4/1983 Griffin ..... 248/242
4,401,222 A * 8/1983 Kulikowski et al. ..... 211/94.01
4,552,272 A 11/1985 Field
4,736,997 A * 4/1988 Besore et al. ..... 312/236
4,809,856 A 3/1989 Muth
5,154,388 A * 10/1992 Magaro ..... 248/248
5,199,579 A * 4/1993 Van Duyne ..... 211/90.04
5,224,610 A * 7/1993 Veazey ..... 211/87.01
5,575,444 A * 11/1996 Otema ..... 248/242
6,273,534 B1 8/2001 Bueley et al.
6,349,507 B1 * 2/2002 Muellerleile ..... 52/36.5

(Continued)

FOREIGN PATENT DOCUMENTS

DE 3510330 3/1993

(Continued)

*Primary Examiner* — Darnell Jayne
*Assistant Examiner* — Devin Barnett
(74) *Attorney, Agent, or Firm* — Andrus, Sceales, Starke & Sawall, LLP

(57) ABSTRACT

A storage system is provided including fixed and mobile frames disposed in modules forming the storage system. Each module also includes one or more mounting rails formed with engagement structures that can be utilized to attach storage bins and slat wall pegs, among other structures, to the rails in order to hold various items within the bins and rails in various configurations on the rails. The rails and other supporting structures such as shelves and work surfaces can also be secured to the frames, optionally in inclined configurations with respect to the frames. The frame structures and storage modules are readily conformable to accommodate different environments and uses for the storage system.

13 Claims, 11 Drawing Sheets

U.S. PATENT DOCUMENTS

| | | | | |
|---|---|---|---|---|
| 6,471,080 | B1 * | 10/2002 | Hoffmann | 211/126.1 |
| 6,487,978 | B1 * | 12/2002 | Hamberg | 108/108 |
| 6,641,098 | B1 * | 11/2003 | Proffitt | 248/243 |
| 6,669,154 | B1 * | 12/2003 | Remmers | 248/225.11 |
| 7,121,104 | B2 * | 10/2006 | Howington et al. | 62/256 |
| 7,128,221 | B2 * | 10/2006 | Metcalf | 211/59.2 |
| 7,246,711 | B1 * | 7/2007 | Metcalf | 211/175 |
| 7,428,972 | B2 * | 9/2008 | Warner et al. | 211/59.1 |
| 2003/0051415 | A1 | 3/2003 | Remelts et al. | |
| 2004/0050810 | A1 * | 3/2004 | Shai | 211/87.01 |
| 2004/0221772 | A1 | 11/2004 | Narkis et al. | |
| 2006/0255699 | A1 | 11/2006 | Punzel et al. | |
| 2007/0188058 | A1 | 8/2007 | Punzel et al. | |
| 2010/0219144 | A1 * | 9/2010 | Salmon et al. | 211/94.01 |

FOREIGN PATENT DOCUMENTS

| | | |
|---|---|---|
| EP | 0294608 | 12/1988 |
| GB | 359010 | 10/1931 |
| GB | 1261512 | 1/1972 |
| GB | 2088702 | 6/1982 |
| WO | WO 95/13003 | 5/1995 |

* cited by examiner 14
39
24
32
30
36
28
40
20
60
46
31
5
34
26
38
6

STORAGE SYSTEM WITH ACCESSORY MOUNTING RAIL

CROSS-REFERENCE TO RELATED APPLICATIONS

This application claims priority from U.S. Provisional Patent Application Ser. No. 60/941,850, filed on Jun. 4, 2007, which is incorporated herein by reference in its entirety.

FIELD OF THE INVENTION

The present invention relates to storage systems, and more specifically to a storage system including a rail securable to the system in multiple orientations and onto which a number of different supporting members can be releasably positioned in various configurations.

BACKGROUND OF THE INVENTION

In numerous environments it is necessary to store a large number of items in a relatively small space. To do so, a wide variety of storage systems have been developed that enable many different items to be held in a high concentration within the system. These systems employ different types of containers to hold the items within the systems, including bins and pegs that are mountable to the surfaces of the storage systems. The items to be held in the containers can then be placed in the containers for later removal when desired.

One issue with the majority of the prior art storage systems is the relative inability of the systems to be modified to accommodate different types of item containers and to include different structures for use in different situations. For example, in a large number of pharmacy environments, the storage systems utilized therein are provided only with shelves and slat wall peg options for holding items thereon. The pegs are limited to holding suitably formed containers thereon. The shelves, while able to hold items directly thereon and to support other types of containers, such as plastic storage bins, have issues with regard to dust collection on the surfaces of the shelves, which is highly undesirable in pharmacy environments.

Therefore, it is desirable to develop a storage system that can be easily modified in its construction to allow the system to be altered quickly to accommodate the particular configuration desired, and/or the particular environment in which the storage system is to be utilized. Further, the storage system should include components that are formed to be able to be secured to the storage system structure in different orientations, and to have different types of storage containers attached directly to them without additional modifications or supporting structures to eliminate the cleaning and assembly issues associated with prior art storage systems.

SUMMARY OF THE INVENTION

According to a first aspect of the present invention, a modular storage system is provided in which the system has a base structure formed of separate modules that can be configured as desired for the particular environment in which the system is to be used. The modules are assembled from frames including supports that can have various additional structures secured thereto, such as shelves, storage bin rails, slat wall pegs, hangers and other support members. The supports can also have other structures secured to the supports, such as work surfaces and corresponding features, such as lighting and shelves or other storages bins disposed under the work surface. The modules can also be configured to enable one or more of the frames making up the modules to be movable with respect to the fixed frames.

According to another aspect of the present invention, the storage system includes a rail support structure that is attachable to the supports of the frames in each module. The rail is configured to enable various types of storage structures to be engaged and directly supported by the rail, including both storage bins of various sizes, and slat wall accessories. Further, the rail can be attached to the supports for the modules in various orientations to enable the storage containers held by the rails to be disposed in various configurations that allow for the most efficient use of the storage space provided within the storage system, as well as easiest access for the user.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
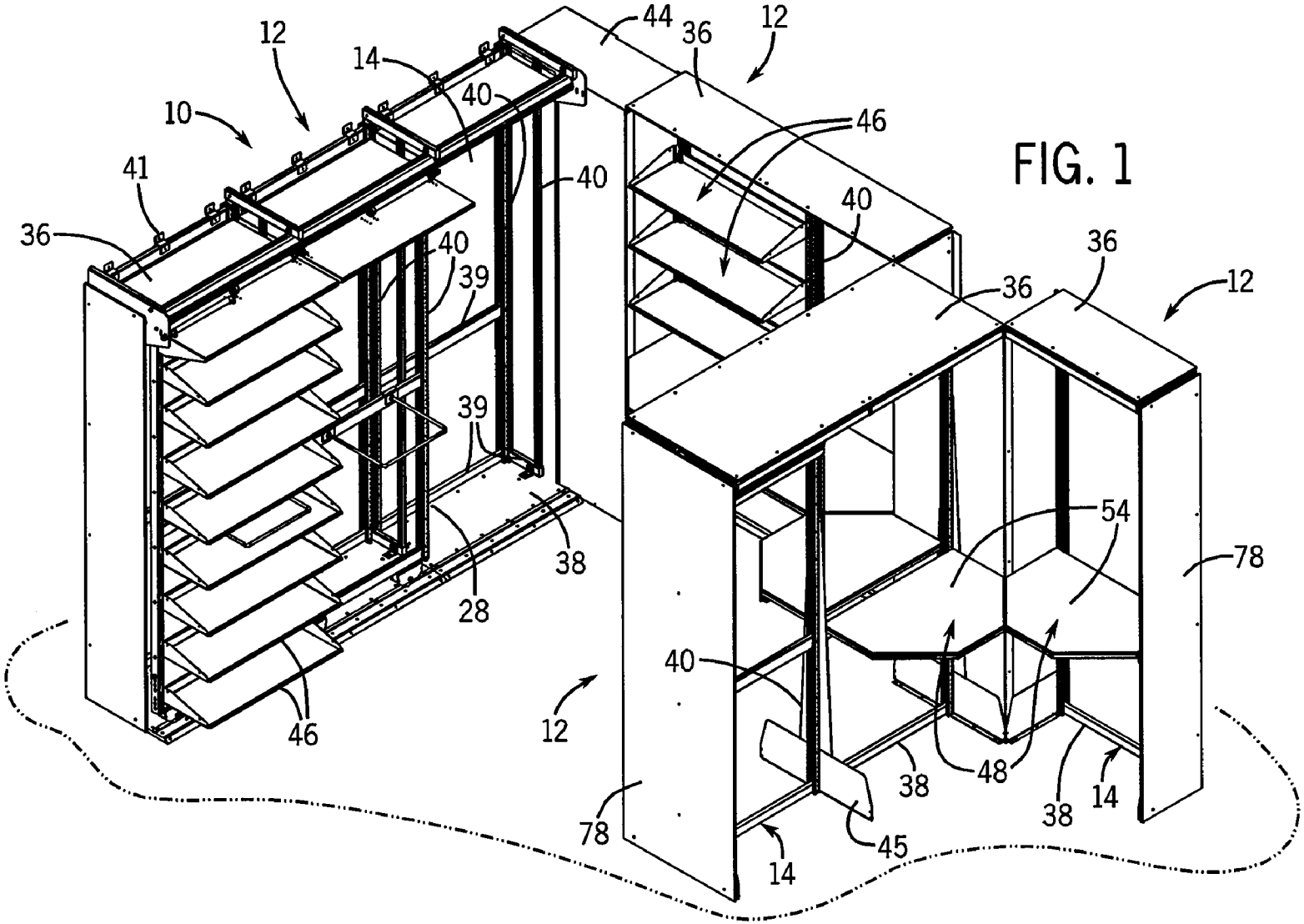
FIG. 1 is an isometric view of the storage system constructed according to the present invention.
Figure 2:
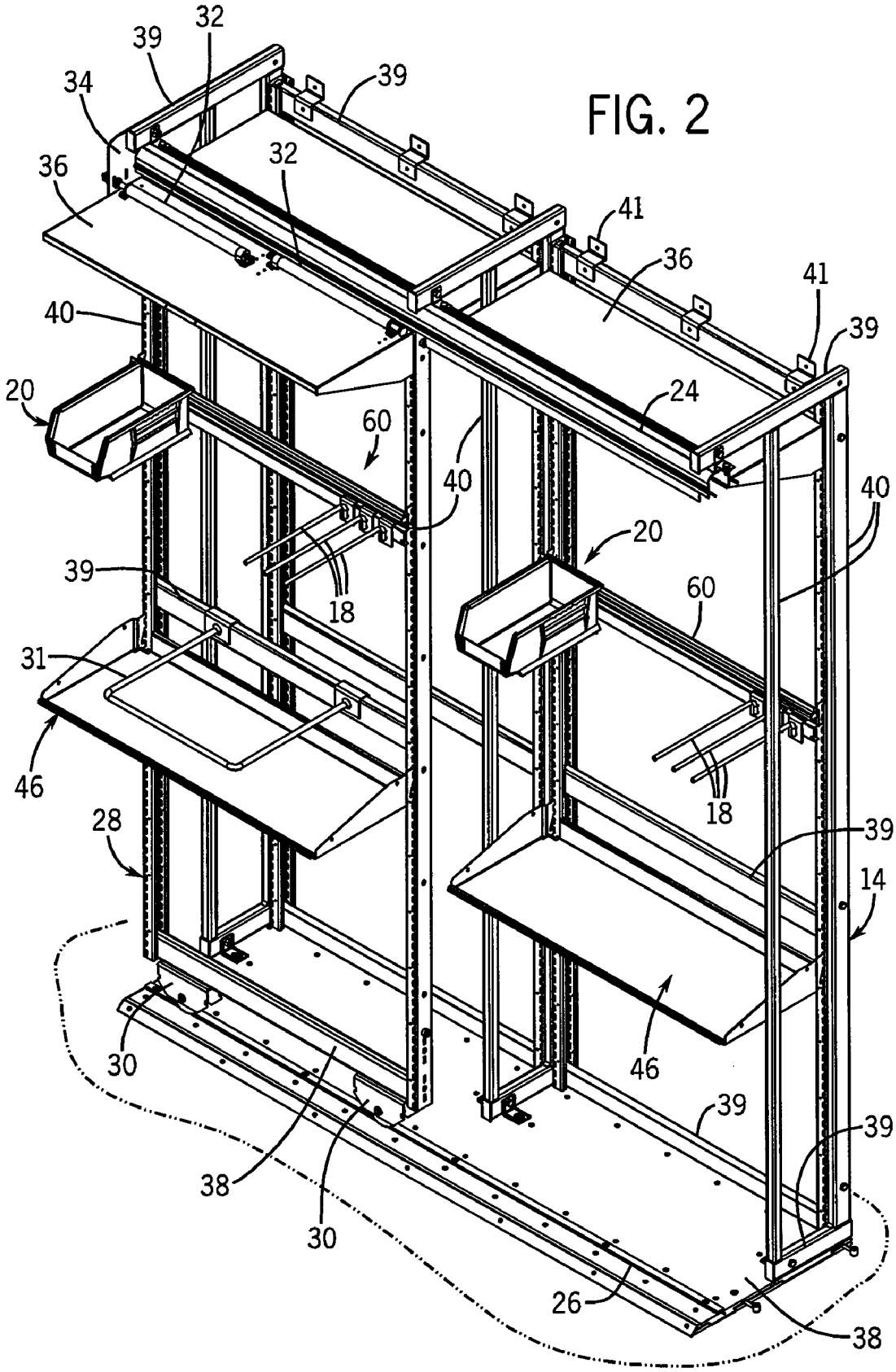
FIG. 2 is an isometric view of a first embodiment of storage module of the storage system of FIG. 1.
Figure 3:
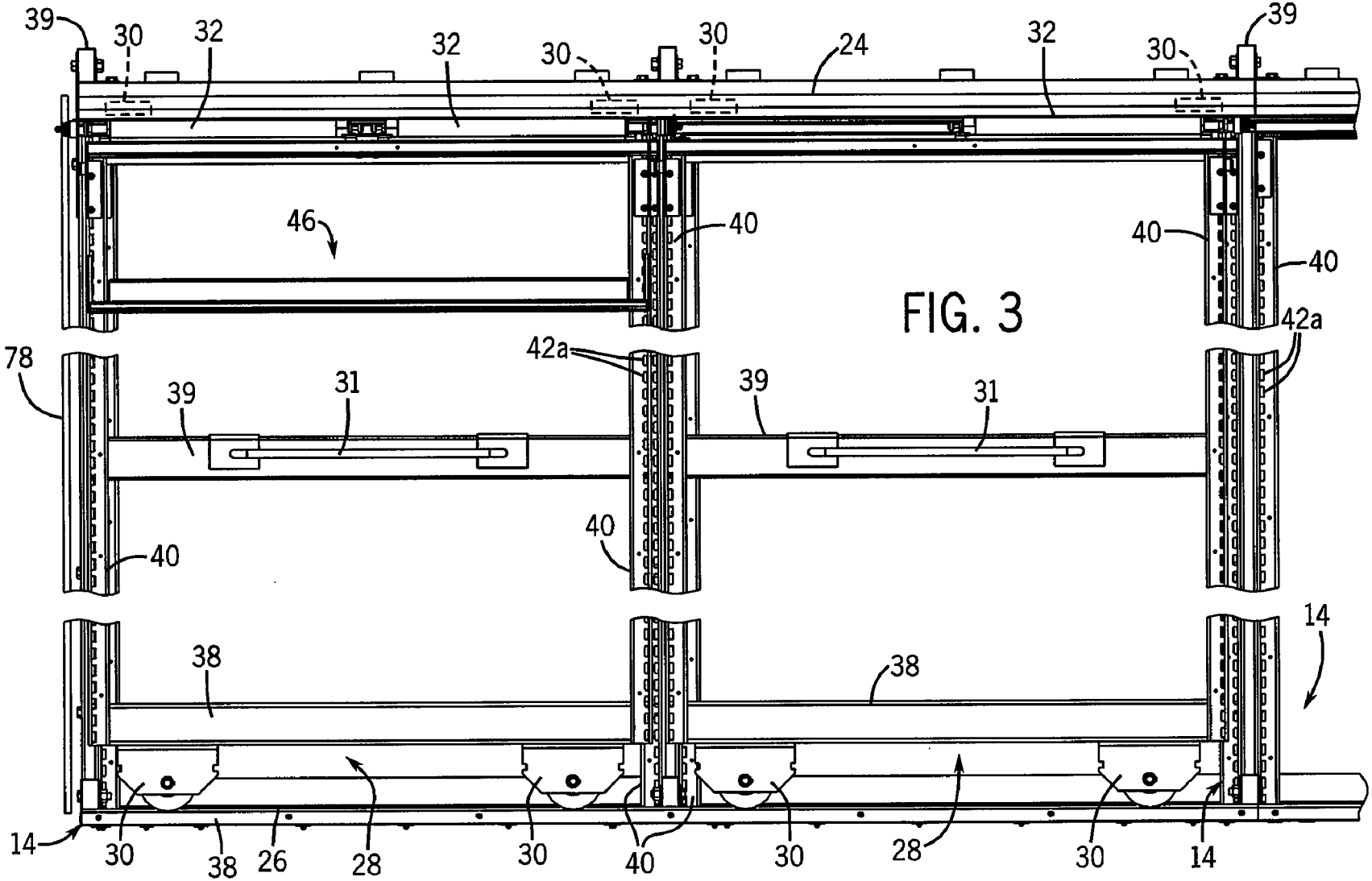
FIG. 3 is a partially broken away, front plan view of a second embodiment of a storage module of the storage module of FIG. 1.

With reference now to the drawing figures in which like reference numerals designate like parts throughout the disclosure, a storage system constructed according to the present invention is indicated generally at 10 in FIG. 1. The storage system 10 is formed of a number of modules 12 and that can be secured to one another in various configurations depending upon the configuration of the space within which the storage system 10 is to be disposed, similar to that disclosed in U.S. Pat. No. 5,943,967, which is incorporated herein by reference in its entirety.

Referring now to FIGS. 1-4, each module 12 can be formed with a number of individual frames 14 constituting the module 12. Preferably, the modules 12 are formed from between one and three separate frames 14 connected to one another utilizing suitable connecting or fastening means, but other numbers of frames 14 can also be utilized as necessary or desired. Each frame 14 is designed to hold and/or accommodate a number of varying storage units 16 thereon, including, but not limited to, hangers or hooks 18, storage bins 20, and pegs 22. Each of these various storage units 16 is capable of holding a number of different items (not shown) therein in a manner which allows for easy access to the items by an individual.

Figure 10:
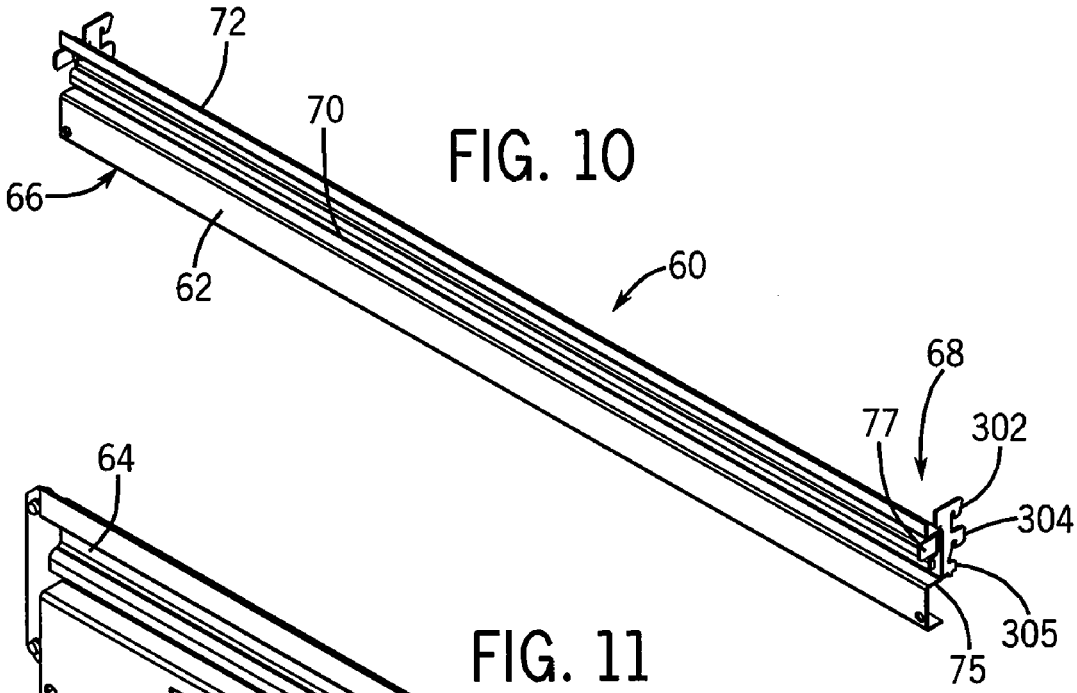
FIG. 10 is an isometric view of a first embodiment of the first embodiment of the mounting rail of FIG. 7.
Figure 11:
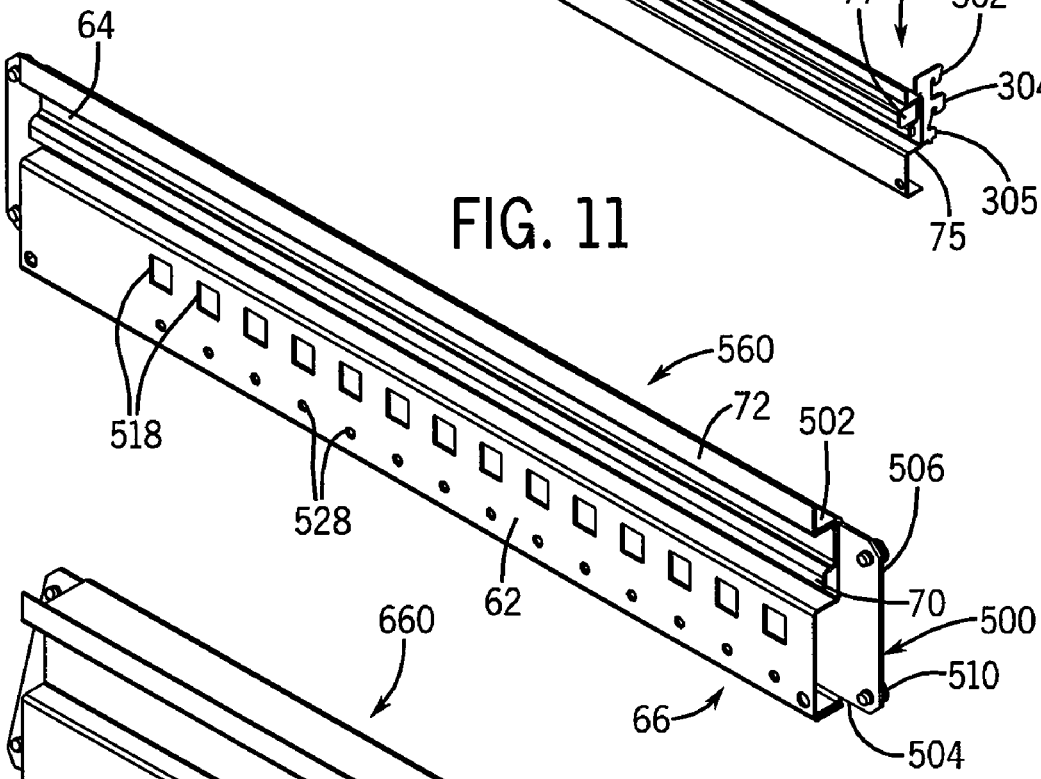
FIG. 11 is an isomeric view of a second embodiment of the mounting rail of FIG. 7.
Figure 14:
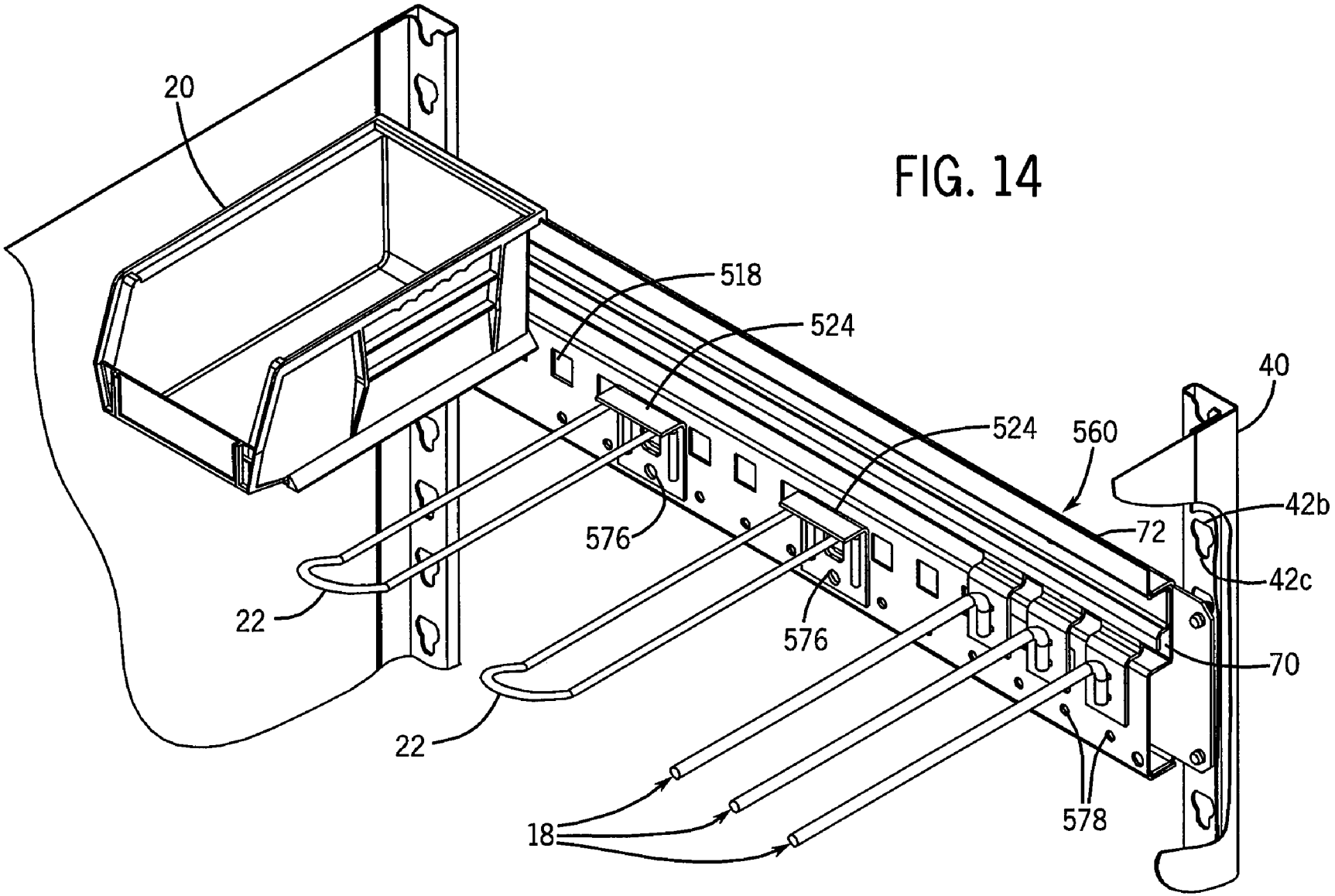
FIG. 14 is an isometric view of the second embodiment of the mounting rail secured to the storage module of FIG. 2.
Figure 15:
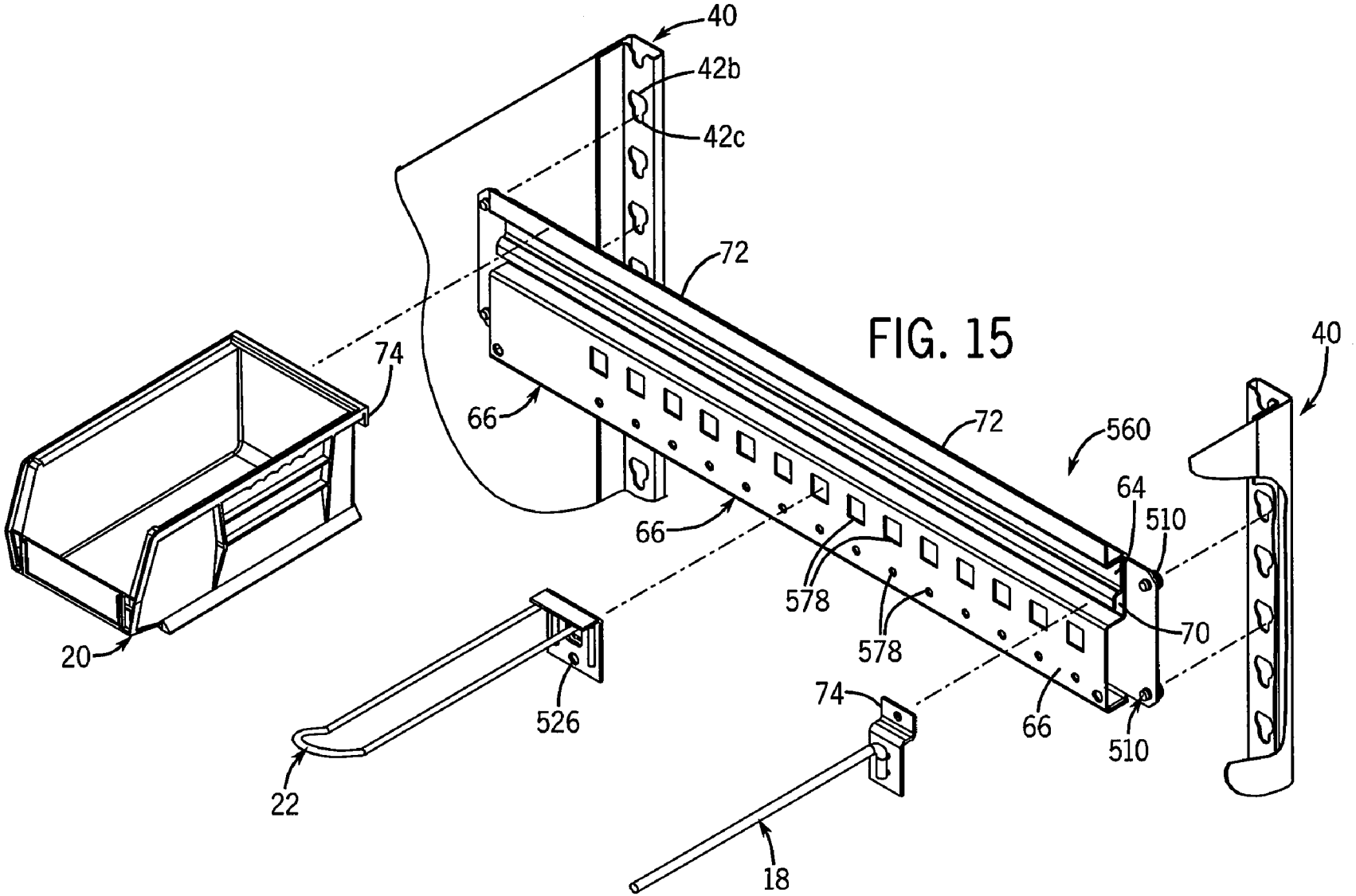
FIG. 15 is an exploded, isometric view of the second embodiment of the mounting rail of FIG. 14.

Looking now at FIGS. 1-4, each frame 14 is formed with a top member 36 and a bottom member 38 between which are secured two or more vertical supports 40 that can be joined by horizontal supports 39. The top member 36 can also function as a canopy for each individual module 12 in order to provide a more aesthetically pleasing appearance to the module 12 as well as to provide a dust cover to the modules 12. The supports 40 include a number of apertures 42 spaced along the length of the supports 40 in order to enable various structures to be secured to the supports 40 utilizing the apertures 42. The supports 40 can be U-shaped, with the apertures 42 disposed on the opposed surfaces of the support 40, or can be square or rectangular in shape, as in FIGS. 10 and 11, with apertures 42 on each surface of the support 40. Also, depending upon the form of the items to be secured to the supports 40 via the apertures 42, the apertures 42 can take various shapes to conform to the items, such as vertically extending rectangular slots 42*a* (FIGS. 2, 3, 7, 8 and 13), or as generally circular openings 42*b* having a downwardly extending notch 42*c* (FIGS. 14-15).

In addition, the top member 36, bottom member 38 and/or supports 40 of the frames 14 can be secured to the floor, the ceiling and/or a wall, such as by brackets 41, or to various corner or end filler structures 44 in order to provide additional support to each frame 14. For the frames 14, the structure can also include various side supports 43 that provide additional support to the frame 14, especially when a single fixed frame 14 is to be free-standing with various storage units 16 disposed on both sides of the particular fixed frame 14. The side supports 43 can take numerous forms including expanded base supports 45, or additional vertical supports 40 spaced forwardly from and connected to the supports 40 to which the storage units 16 are secured.

Some of the structures that can be secured to the vertical supports 40 in each frame include shelves 46, as best shown in FIGS. 1, 2, 4 and 13. The shelves 46 include a flat planar surface 50 extending between a pair of brackets 52 that are releasably engageable within the slots 42*a* in the supports 40 to enable the shelves 46 to be positioned as desired without the need for any additional tools or fasteners. In the embodiment shown in FIGS. 4 and 13, the shelves 46 can be designed to be secured to a given frame 14 in a generally horizontal position or in a downwardly inclined position with respect to the frame 14 depending on the use for the particular shelf 46 due the configuration of the brackets 52 secured to the sides of the shelf 46. The brackets 52 include a body 102 that is secured to the shelf 46, and three tabs 104, 106 and 108 that extend outwardly from the body 102 to define corresponding recesses 110, 112 and 114 between the tabs 104, 106 and 108 and the body 102. The tabs 104 and 106 are positioned on the body 102 such that when the tabs 104 and 106 are engaged within selected slots 42*a* on the vertical supports 40, the shelf is disposed in a flat, horizontal orientation. However, when the tabs 106 and 108 are engaged with the selected slots 42*a*, the shelf 46 is disposed in a downwardly inclined orientation with regard to the vertical supports 40 that preferably is about seventeen degrees with regard to horizontal. In addition, the shelves 46 can be formed with an outer lip 53 on the surface 50 generally opposite the brackets 52 that enables the shelf 46 to retain items thereon even when positioned at an incline with respect to the frame 14.

Looking now at FIG. 1, there also can be work surfaces 48 secured to the various frames 14 that include a flat planar surface 54 supported at opposite ends by a pair of brackets (not shown) that are engageable within the apertures 42 in the rails 40 similarly to the brackets 52 on the shelves 46. The planar surface 54 can be formed to have an overall length equal to the length of one or multiple frames 14, in order to provide the desired area for the work surface 48. Additionally, in a preferred embodiment, the planar surface 54 includes one or more chamfered corners 58 to minimize any interference by the work surface 48 with adjacent frames 14 or modules 12 of the storage system 10, and to enable work surfaces 48 positioned in adjacent and/or perpendicular modules 12 to form a continuous work surface 48 between the modules 12.

The storage system 10 can also include end covers 78 positioned vertically along the various ends of each module 12 and secured to the vertical supports 40 to provide a more aesthetically pleasing appearance to the various modules 12 and the overall system 10. These covers 78 can be formed to have a width equal to the width of a single module 12 or a pair of modules 12 depending upon the particular position for the cover 78 on the system 10.

A preferred embodiment of the storage system 10 is illustrated in FIG. 1 as having frames 14 formed with two, three or four evenly spaced vertical supports 40, enabling the frames 14 to accommodate shelves 46 and work surfaces 48 having an overall width approximately equal to the spacing of the vertical supports 40 forming the frames 14. This allows the frames 14 and modules 12 of the system 10 to be optimized for utilization with various storage units 16, such as storage bins 20, having specified widths in order to enable the greatest number of storage units 16 to be mounted within a particular module 12.

Looking now at FIGS. 1-6, certain modules 12 are formed from a number of fixed frames 14 secured to one another, but also including upper and lower guide tracks 24 and 26 secured to the upper member 36 and lower member 38 of each fixed frame 14. The tracks 24 and 26 are configured to movably support one or more mobile frames 28 thereon. The mobile frames 28 are formed similarly to the fixed frames 14 with a pair of vertical supports 40 having apertures 42 formed therein, but include roller assemblies 30 disposed on upper and lower horizontal supports 39 of each mobile frame 28 and rotatably positioned within the tracks 24 and 26 on the fixed frames 14. The roller assemblies 30 are engaged with the tracks 24 and 26 in a manner that allows the roller assemblies 30 to move within and/or along the respective track 24 and 26 to guide the movement of the mobile frame 28 with respect to the fixed frame 14. To assist in moving the mobile frames 28 along the tracks 24 and 26, the frames 28 also include handles 31 disposed on horizontal supports 39 secured between the vertical supports 40 forming each side of the mobile frame 28.

Each module 12 can include multiple mobile frames 28 attached to the tracks 24 and 26 separately from one another such that mobile frames 28 are movable independently with respect to each other. Further, the tracks 24 and 26 are constructed such that the mobile frames 28 secured thereto are positioned in front of the fixed frames 14 a sufficient distance such that the position and movement of the mobile frames 28 along the tracks 24 and 26 does not contact or otherwise interfere with those storage units 16 secured to the fixed frames 14. Also, the upper member 36 and lower member 38 for the modules 12 can be designed to accommodate multiple pairs of spaced tracks 24 and 26 that are disposed in front of the fixed frames 14, such that a number of mobile frames 28 can be disposed in front of the fixed frames 14 and one another.

In order to control the movement of the mobile frames 28 along the tracks 24 and 26, each mobile frame 28 can include a deceleration device 32 adjacent to the upper end of the mobile frame 28, as best shown in FIGS. 1-5. The deceleration device 32 extends laterally from the mobile frame 28 in order to engage a stop 34 positioned at each end of the fixed frames 14 forming the module 12. Preferably, the deceleration device 32 is resiliently biased to an extended position by a suitable biasing element or mechanism (not shown) such as a spring or gas cylinder, such that when the deceleration device 32 contacts the stop 34, the biasing element is gradually compressed by continued movement of the mobile frame 28 and consequently slows the movement of the mobile frame 28 with regard to the fixed frames 14. This prevents any sudden jarring stops for the mobile frame 28 which could cause the items held on the mobile frames 28 to become dislodged from within the storage units 16 located thereon, and/or damage to the mobile frames 28.

Figures 4, 5, 6:
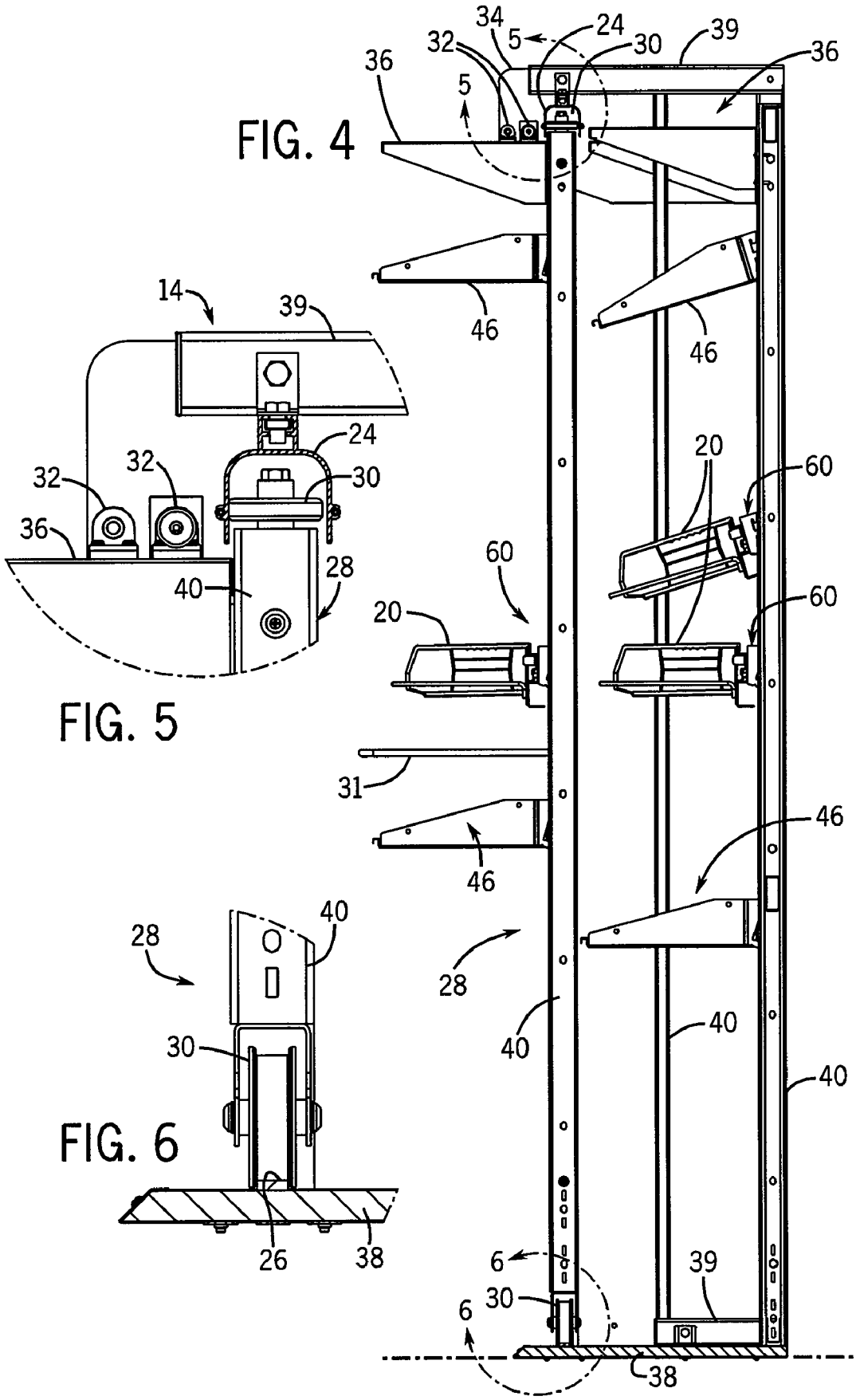
FIG. 4 is a side plan view of the storage module of FIG. 2.
FIG. 5 is a partially broken away, side plan view of an upper guide assembly of the storage module of FIG. 4.
FIG. 6 is a partially broken away, side plan view of a lower guide assembly of the storage module of FIG. 4.
Figure 7:
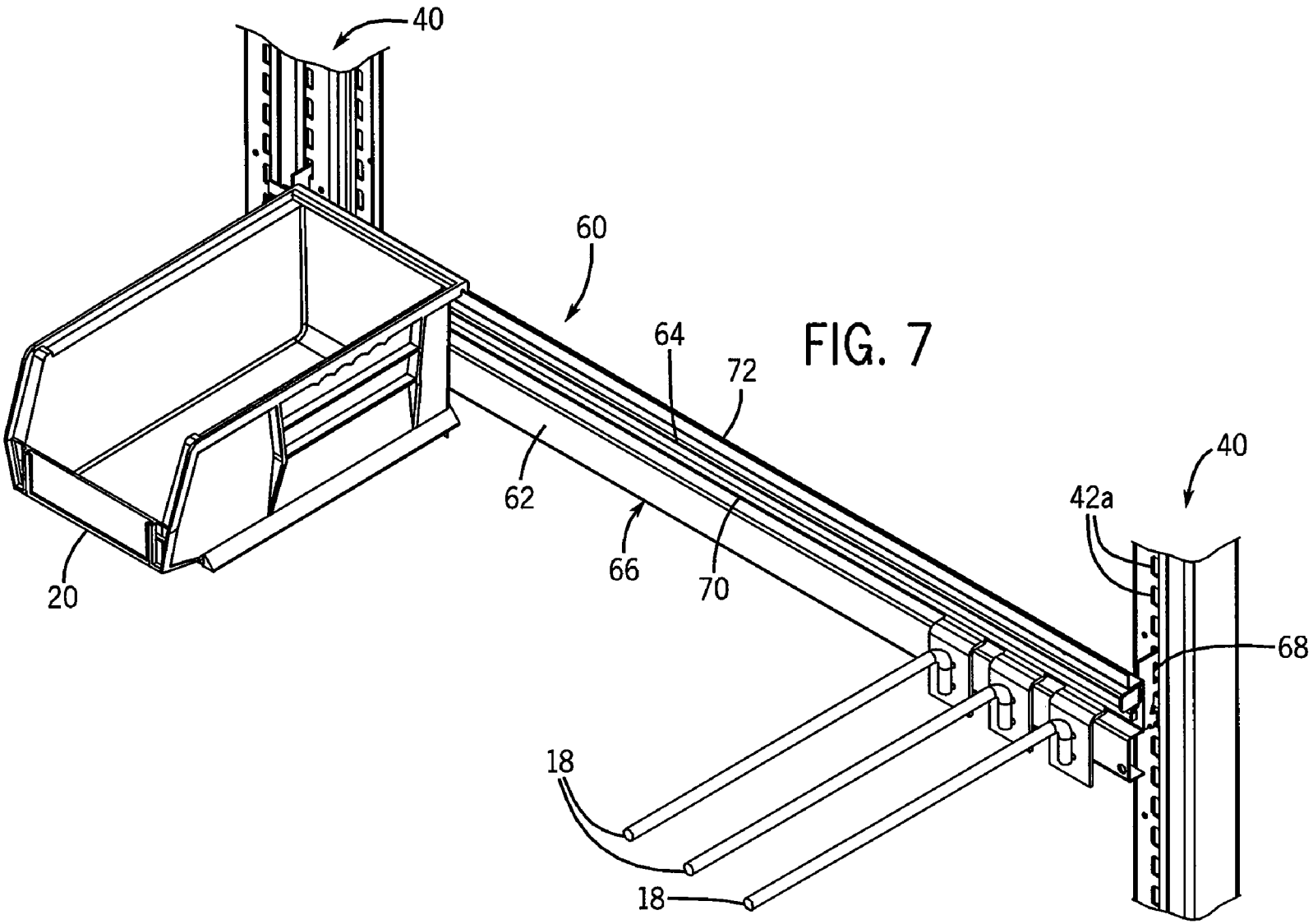
FIG. 7 is an isometric view of a first embodiment of a mounting rail for the storage module of FIG. 1.
Figure 8:
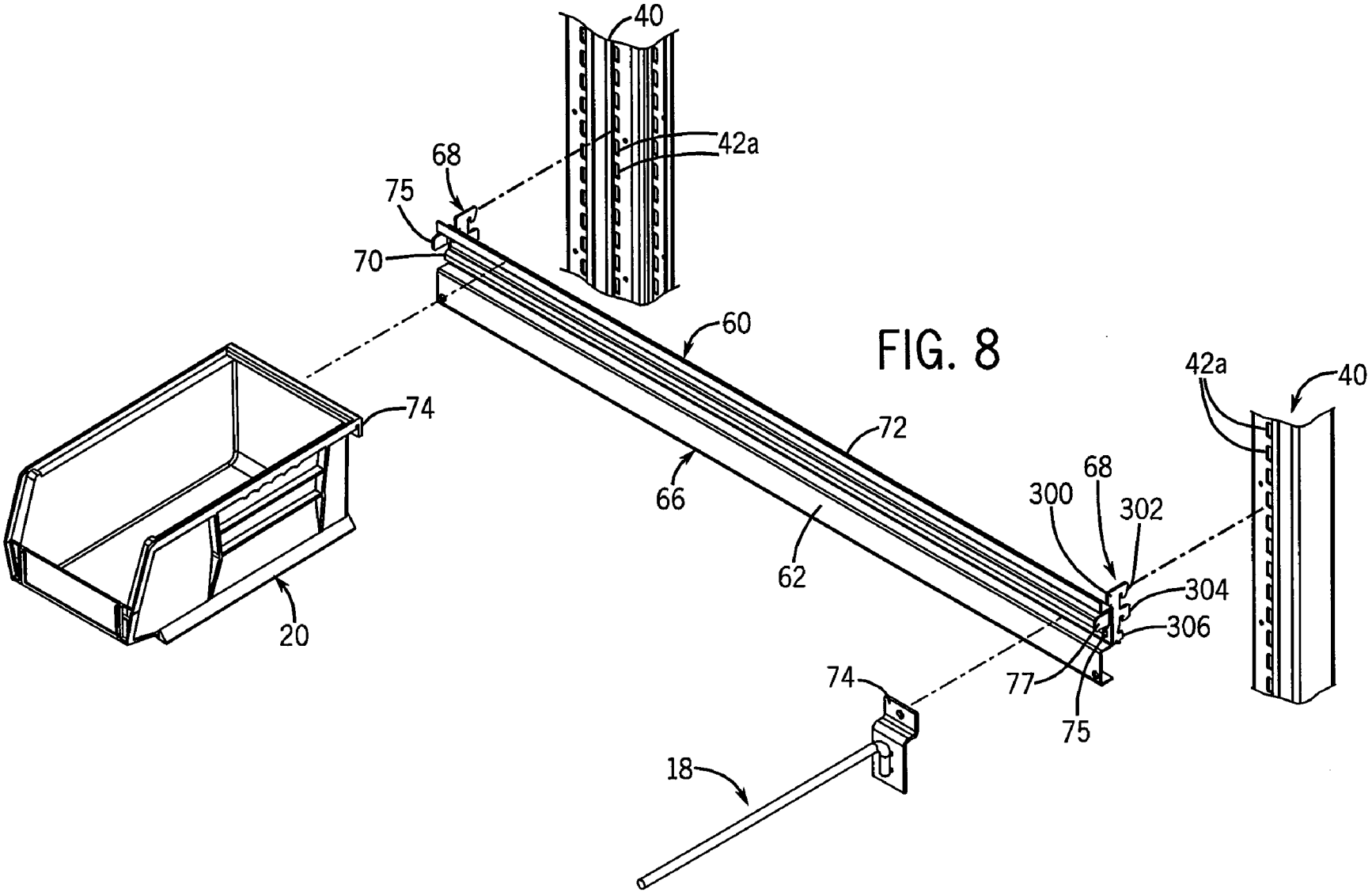
FIG. 8 is an exploded, isometric view of the first embodiment of the mounting rail of FIG. 7.
Figure 9:
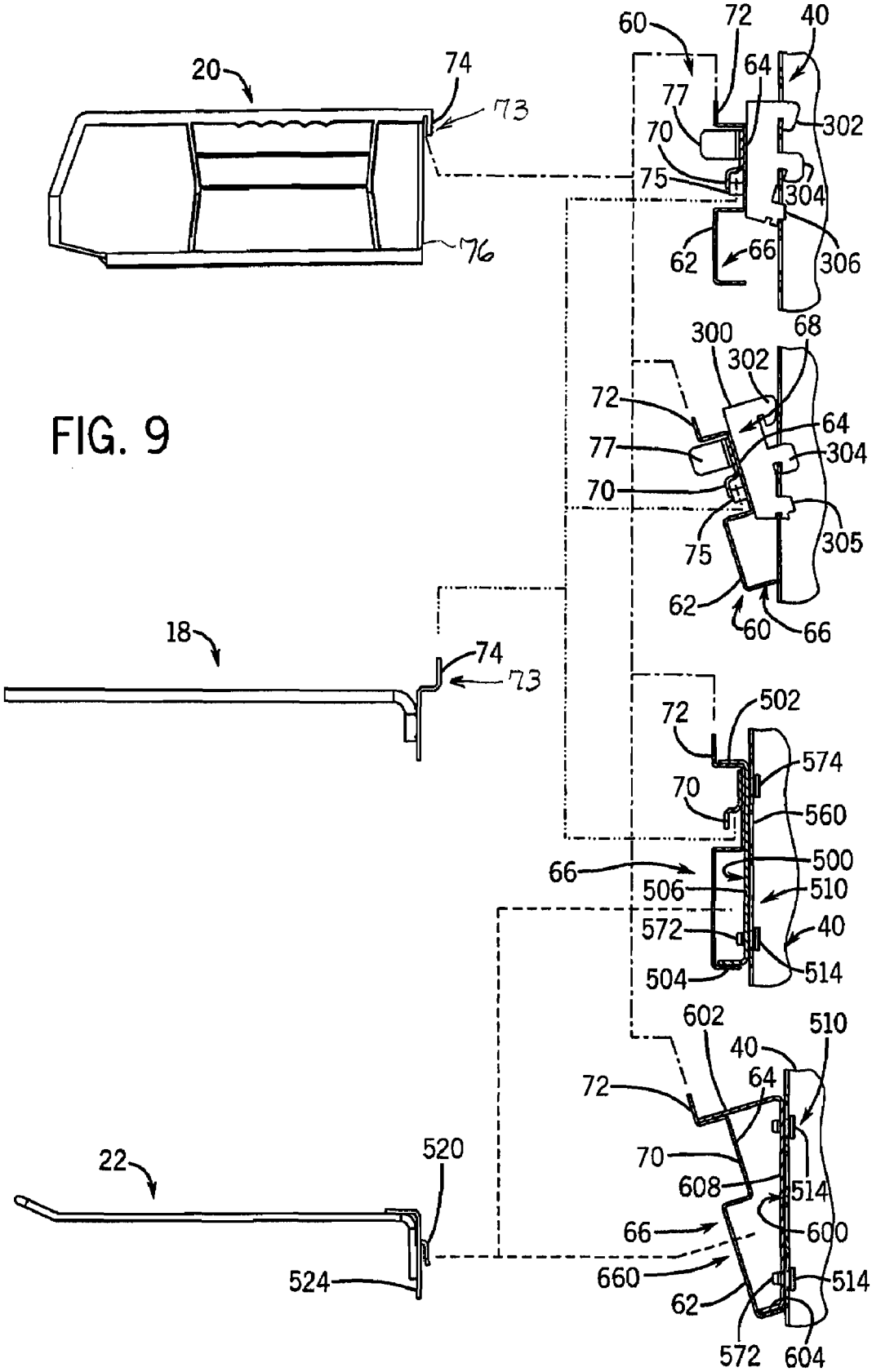
FIG. 9 is a side plan view of three embodiments of the mounting rail of FIG. 7.

Looking now at FIGS. 4 and 7-10, each frame 14 or 28 also includes one or more support rails 60 that are secured between each of the vertical supports 40 in the particular frame 14 or 28. Each support rail 60 includes a lower portion 62 and an upper portion 64 that are each utilized to engage and hold various storage units 16 thereon. The lower portion 62 and upper portion 64 are formed as oppositely curved U-shaped portions of an integral rigid member 66, such that when the rail 60 is secured to the vertical supports 40, the lower portion 62 extends outwardly away from the supports 40, while the upper portion 64 extends inwardly toward the supports 40. Opposite the lower portion 62, each end of the upper portion 64 includes a mounting arrangement or an engagement bracket 68 that is releasably engageable with the slots or mounting structures 42*a* formed in the supports 40 to mount the support rail 60 on the frame 14 or 28 where desired. The engagement brackets 68 enable the support rail 60 to be mounted to the vertical supports 40 in either a horizontal configuration or a downwardly inclined configuration, as best shown in FIGS. 4 and 9. To provide this function, each bracket 68 is formed similarly to the bracket 52 used with the shelves 46 with a body or mounting arrangement 300 and three tabs or mounting members 302, 304 and 306 extending outwardly therefrom in a direction opposite the upper portion 64. When the tabs 302 and 304 are engaged with the selected slots 42*a* on the supports 40, the rail 60 is mounted in a horizontal orientation, and when the tabs 304 and 306 are secured to the selected slots 42*a*, the rail 60 is oriented in a downwardly inclined position, preferably at an angle of seventeen degrees from horizontal.

Opposite each engagement bracket 68, the upper portion 64 of the rail 60 includes a pair of opposed securing flanges or engagement structures 70 and 72. The flange 70 is positioned adjacent and extends towards the lower portion 62, while the flange 72 is disposed on and preferably integrally formed with the opposite end of the upper portion 64 and extends away from the flange 70. The flange 70, in conjunction with the portion of the rail 60 connecting the lower portion 62 and upper portion 64 and a planar exposed surface of the lower portion 62, creates an attachment point for a an attachment flange 73 present on a number of different types of hooks 18 and slat wall pegs 22 to support and engage the hooks 18 and pegs 22 in either the horizontal or downwardly inclined positions. Further, because the flange 70 is preferably formed to be continuous across the entire length of the rail 60, the number and type of hooks 18 and/or pegs 22 that can be secured to the rail 60 using the flange 70 can be varied as desired. As seen in FIG. 9, the planar exposed surface of lower portion 62 extends beyond the engagement structure or flange 70 and defines a resting support in abutting relationship with a lower end of the storage elements 18, 20.

The flange 72 provides an attachment point for a tab 74 disposed at the rear of a conventional storage bin 20. When the tab 74 on the bin 20 is engaged with the flange 72, the lower end 76 of the rear surface of the bin 20 is positioned against the lower portion 62, such that the rail 60 provides a stable support for the storage bin 20 when the rail 60 is in either the horizontal or downwardly inclined position.

Preferably, a stop structure defined by first and second stop structures 77, 75, respectively, is disposed at each end of both the flanges or engagement structures 70 and 72 in order to prevent the hooks 18, pegs 22 and bins 20 from sliding off of either end of the flanges 70 and 72. Preferably, the stop structures 75 and 77 are integrally formed as parts of each securing engagement bracket 68 that are engaged with and extend through the rail 60 to secure each bracket 68 to the rail 60. The stop structure 77 is located between the first and second engagement structures or flanges 72 and 70. The stop structure 75 is located between the second engagement structure or flange 70 and the lower portion 62. To perform the required stopping function, the stop structure 75 engages the portion of the hook 18 or peg 22 engaged with the flange 70, while the stop structure 77 engages the body of a bin 20 engaged with the flange 72. Alternatively, the rigid member 66 including the lower portion 62 and the upper portion 64, the securing engagement brackets 68 and the flanges 70 and 72 are preferably integrally formed with each other, to provide a support rail 60 that is simple to install and utilize in attaching and supporting storage units 16 in various configurations.

As a result of the means of engagement between the rails 60 and the vertical supports 40, the positioning of the rails 60 within each frame 14 and 28 can be varied as necessary in order to enable storage bins 20, hooks 18 and pegs 22 of various shapes and sizes to be disposed in any desired configuration and in any arrangement along the rail 60 within each frame 14 and 28.

Referring now to FIGS. 9, 11, 12, 14 and 15, other embodiments for the rail 60 are illustrated. In a second embodiment for the rail 560, the engagement brackets 68 are omitted and the rigid member 66 is affixed in any suitable manner to a back panel 500. The back panel 500 is formed of a generally rigid material, similar to the rigid member 66, and that includes an upper section 502 secured to the upper portion 64 of the rigid member 66 and a lower section 504 secured to the lower portion 62 of the rigid member 66. The back panel 500 also includes a central section 506 that is joined to a number of pins 510. The pins 510 are formed similarly to the pins 402 for shelves 46', with a shaft 512 extending through and connected to the central portion 506, and a head 514 connected to the shaft 512 opposite the back panel 500. The pins 510 enable the rail 560 to be secured to the vertical supports 40 including the openings 42*b* and notches 42*c* to position the rail 560 in a horizontal orientation, as best shown in FIG. 9.

In addition, the lower portion 62 of the rail 560 can be formed with other mounting structures 516 therein, such as apertures 518 that are engagable with securing tabs 520 disposed on U-shaped hooks 22. The tabs 520 are formed in a base 524 for the hook 22 which also includes a locking aperture 526 disposed directly beneath the tab 520 and alignable with an opening 528 in the lower portion 62 of the rail 560 to receive a suitable locking member (not shown) therein which secured the hook 22 to the rail 560.

Figure 12:
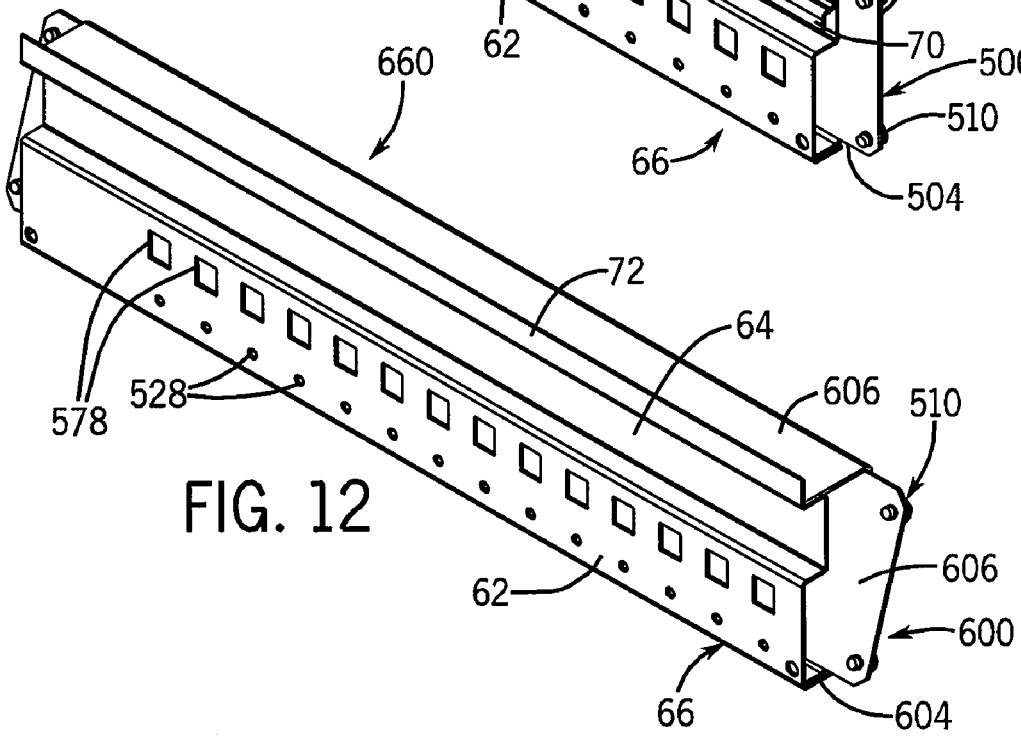
FIG. 12 is an isometric view of a third embodiment of the mounting rail of FIG. 7.
Figure 13:
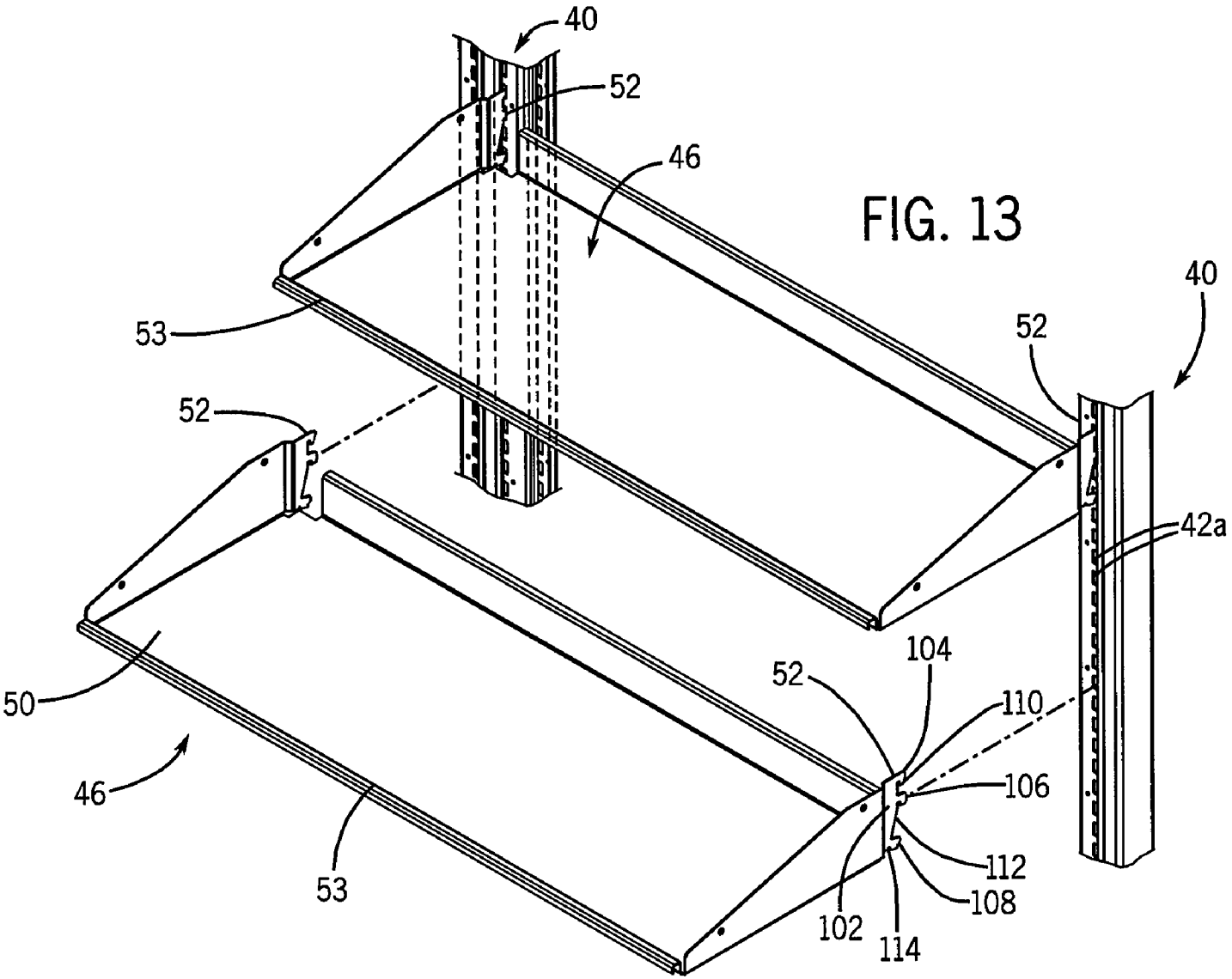
FIG. 13 is an isometric view of a shelf secured to the storage module of FIG. 2.

In a third embodiment for the rail 660, best shown in FIGS. 9 and 12, the rail 660 is formed similarly to the rail 560, with the exception of the back panel 600. For the rail 660, the back panel 600 is formed with an upper section 602 and a lower section 604 that are each angled downwardly from perpendicular with regard to the central section 606. Further, the upper section 602 is formed with a length greater than that of the lower section 604, such that the rigid member 66 is positioned in a downwardly inclined position with regard to the central portion 606 when affixed to the back member 600. In this configuration, when the rail 660 is secured to the vertical supports 40 by the pins 510, the rigid member 66 of the rail 660 is disposed in a downwardly inclined position with regard to horizontal that is similar to the orientation of the rail 60 in its downwardly inclined configuration.

Other features for the system 10 are also contemplated in alternative embodiments for the system 10, such as a cart or multiple work surfaces (not shown) having various drawers, work surfaces or other features thereon, or pull out sections or shelves (not shown) in frames 14, or various lighting or locking features for the frames 14 and/or modules 12 of the storage system 10. In addition, the constriction of the brackets 52 and 68 for holding the shelves 46 and rails 60 on the supports 40 can be formed with alternative engaging structures other than the tabs 104-108, such as pins 402, or any other suitable engaging structure.

Various other alternatives are contemplated is being within the scope of the following claims particularly pointing out and distinctly claiming the subject matter regarded as the invention.

We claim:

1. A storage system comprising:

a) at least one storage module including at least one frame having a pair of upwardly extending supports including mounting structures thereon; and b) at least one mounting rail provided with opposite ends and connected between the pair of upwardly extending supports and having an upper portion defining a pair of attachment points above and below one another adapted to separately engage different types of storage elements thereon, and a lower portion beneath the attachment points adapted to support the storage elements thereon, the upper portion of the at least one mounting rail including a first engagement structure providing a first one of the attachment points and adapted to engage at least one first type of storage element thereon, and a second engagement structure creating a second one of the attachment points, spaced from the first engagement structure, lying above the lower portion and adapted to engage at least one second type of storage element thereon, wherein the upper portion and the lower portion are integrally formed as oppositely curved U-shaped portions with the upper portion extending inwardly towards the supports and the lower portion extending outwardly away from the supports, the lower portion having a planar exposed surface extending beyond the second engagement structure and defining a resting support adapted to abut a lower end of the storage elements, wherein the first and second engagement structures have opposite ends provided with stop structure adapted to engage the different types of storage elements and prevent sliding lateral removal thereof from the ends of the first and second engagement structures, the stop structure including a first stop structure located between the first and second engagement structures, and a second stop structure located between the second engagement structure and the lower portion, wherein the upper portion of the at least one mounting rail opposite the attachment points includes a mounting arrangement for securing the at least one mounting rail to the pair of supports in either a horizontal position or an inclined position, and, wherein the mounting arrangement includes an upper mounting member, a middle mounting member, and a lower mounting member, and wherein the at least one mounting rail is secured to the pair of supports in a horizontal position by the upper and middle mounting members, and in a downwardly inclined position by the upper and middle mounting members, and in a downwardly inclined position by the middle and lower mounting members.

2. The storage system of claim 1 wherein the first engagement structure extends continuously across the at least one mounting rail.

3. The storage system of claim 2 wherein the first engagement structure comprises an upwardly extending flange integrally formed with the upper portion of the at least one mounting rail.

4. The storage system of claim 1 wherein the second engagement structure extends continuously across the at least one mounting rail.

5. The storage system of claim 4 wherein the second engagement structure comprises a downwardly extending flange affixed to the upper portion of the at least one mounting rail.

6. The storage system of claim 1 wherein the mounting arrangement includes a number of mounting members angularly spaced from one another and selectively engagable within aligned apertures in the pair of supports.

7. The storage system of claim 1 further comprising at least one shelf connected between the pair of supports, the at least one shelf including a mounting arrangement capable of securing the at least one shelf to the pair of supports in either a horizontal position or an inclined position.

8. The storage system of claim 1 further comprising at least one first type of storage element and at least one second type of storage element mounted laterally adjacent one another on the upper portion of the at least one mounting rail.

9. The storage system of claim 1 wherein the first engagement structure is adapted to slidably engage at least one first type of storage element thereon.

10. The storage system of claim 9 wherein the second engagement structure is adapted to slidably engage at least one second type of storage element thereon.

11. A method for adjusting the configuration of storage element held within a storage system, the method comprising the steps of:

a) providing a storage system including at least one storage module including at least one frame having a pair of upwardly extending supports including mounting structures thereon, and at least one mounting rail provided with opposite ends and connected between the pair of upwardly extending supports, the at least one mounting rail having an upper portion defining a pair of attachment points above and below one another adapted to engage different types of storage elements thereon, and a lower portion beneath the attachment points adapted to support the storage elements, the upper portion including a first engagement structure providing a first one of the attachment points and adapted to engage at least one first type of storage element thereon, and a second engagement structure creating a second one of the attachment points, spaced from the first engagement structure, lying above the lower portion and adapted to engage at least one second type of storage element thereon wherein the upper portion and the lower portion are integrally formed as oppositely curved, U-shaped portions with the upper portion extending inwardly towards the supports and the lower portion extending outwardly away from the supports, the lower portion having a planar exposed surface extending beyond the second engagement structure and defining a resting support adapted to abut a lower end of the storage elements, and wherein the first and second engagement structures have opposite ends provided with stop structure adapted to engage the storage elements and prevent sliding lateral removal thereof from the ends of the first and second engagement structures, the stop structure including a first stop structure located between the first and second engagement structures, and a second stop structure located between the second engagement structure and the lower portion; and b) adjusting the configuration of the at least one mounting rail with regard to the pair of supports, wherein the upper portion of the at least one mounting rail opposite the attachment points includes a mounting arrangement for securing the at least one mounting rail to the pair of supports in either a horizontal position or an inclined position, and wherein the mounting arrangement includes an upper mounting member, a middle mounting member, and a lower mounting member, and wherein the at least one mounting rail is secured to the pair of supports in a horizontal position by the upper and middle mounting members, and in a downwardly inclined position by the middle and lower mounting members.

12. The method of claim 11 wherein the storage system includes a number of storage elements of the first and second type, and wherein step of adjusting the configuration of the at least one mounting rail comprises repositioning the storage elements of the first and second type on the first and second engagement structures.

13. The method of claim 11 wherein the mounting arrangement includes a number of mounting members angularly spaced from one another and selectively engageable with aligned apertures in the pair of supports, and wherein the step of adjusting the configuration of the at least one mounting rail comprises switching the position of the at least one mounting rail on the pair of supports between the horizontal position and the downwardly inclined position.

* * * * *